US006524523B1

(12) United States Patent
Jeng et al.

(10) Patent No.: US 6,524,523 B1
(45) Date of Patent: Feb. 25, 2003

(54) METHOD FOR FORMING DRESSER OF CHEMICAL MECHANICAL POLISHING PAD

(75) Inventors: Sheng-Hun Jeng, ChuPei (TW); Ming-Che Hsu, Taipei (TW)

(73) Assignees: Asia IC Mic-Process, Inc., Hsinchu (TW); Carbo Tzujan Industrial Co., Ltd, Taipei Hsien (TW)

( * ) Notice: Subject to any disclaimer, the term of this patent is extended or adjusted under 35 U.S.C. 154(b) by 0 days.

(21) Appl. No.: 09/964,328

(22) Filed: Sep. 28, 2001

(51) Int. Cl.[7] ..... B22F 7/04

(52) U.S. Cl. ..... 419/8; 419/11; 419/26; 419/36

(58) Field of Search ..... 419/8, 26, 11, 419/36

(56) References Cited

U.S. PATENT DOCUMENTS 6,286,498 B1 * 9/2001 Sung ..... 125/12

* cited by examiner

*Primary Examiner*—Daniel J. Jenkins

(74) *Attorney, Agent, or Firm*—Troxell Law Office PLLC

(57) ABSTRACT

A method for forming dresser of chemical mechanical polishing pad, firstly to make a stainless steel bottom seat. Then preparing metal welding powder and organic glue, mixing the aforesaid metal welding powder, organic glue and adequate ratio of water to welding thick liquid and uniformly distributing or pasting it on the aforesaid dresser bottom seat to form the sintering layer. The aforesaid metal welding material includes the active metal with diamond can form metal carbonate. Then using the computer visual inspection system to proceed the diamond powder distribution, uniformly distributing them for 60 to 2500 grains per square centimeter. Proceeding the sintering process to make the friction layer of chemical mechanical polishing pad dresser.

10 Claims, 4 Drawing Sheets

METHOD FOR FORMING DRESSER OF CHEMICAL MECHANICAL POLISHING PAD

FIELD OF THE INVENTION

This invention relates to a method for forming a dresser pad for chemical mechanical polishing, especially about a method for forming a dresser of a diamond abrasive wheel.

BACKGROUND OF THE INVENTION

In recent years, each integrated circuit company must be decreasing running cost and increasing product competitiveness by increasing the packing density of integrated circuits. To increase the packing density of integrated circuits, not only must the component size be decreased, the distance between components also must be shortened. Recently the rapid development of chemical mechanical polishing (CMP) has become the key technology of rapid increasing of integrated circuit packing density.

The CMP usually places a polishing pad on the circular polishing table, then uses a wafer carrier to press the wafer on the polishing pad with slurry to reach the CMP effect by relative motion between the wafer and the polishing pad.

The polishing pad is composed of blown polyurethane and lubricated by slurry. The production process of using the polishing pad assembly on the CMP machine and the assembly process is labor-consuming. All of the polishing pad cost, the labor cost of polishing pad assembly on the CMP machine and the production loss during the assembly process increases the CMP cost.

The main reason for polishing pad wear is the smoothing phenomenon, that is, during the CMP process, the polishing grains in the slurry and by-product of polishing will be buried in and block the holes of polishing pad. The smoothing will decrease the polishing rate; and make the polishing time and degree not easily controlled. To overcome the smoothing problem, the polishing pad has to be pruned periodically to remove the buried polishing grains and by-products in the pad. The present pruning technique includes liquid rinsing, gas blowing and polishing pad. The polishing pad effect is the best. A polishing pad dresser on the CMP machine uses a rotating diamond abrasive wheel to prune the polishing pad. The smoothing problem is expected to be overcome after pruning to increase the CMP polishing rate.

There are two methods to form the aforesaid diamond abrasive wheel on the polishing pad dresser: electrical plating and sintering. During the plating process, the diamond is joined with welding material by physical bonding. Since the diamond itself doesn't conduct, it will hinder the welding material from being plated on the joint of the diamond and the welding material surface so there will be a concavity on the joint and the grab strength will be decreased. Therefore, the diamond abrasive wheel formed by plating is not suitable for the CMP pad dresser.

In the sintering process, the welding material like copper, silver and some active metals like titanium is sprayed or green printed on the polishing pad dresser to form a sintering layer, then the diamond grains are randomly distributed on the sintering layer prior to feeding it into the high temperature sintering stove. In the conventional sintering process, the density and uniformity of diamond distribution and the ratio of diamond grain exposure cannot be precisely controlled. So the polishing pad dresser made by conventional technology has poor pruning effect on the CMP pad; the uniformity is not stable and hard to be controlled.

To increase the CMP pad quality and life, the polishing rate, the uniformity and stability of polishing pad dresser has to be precisely controlled.

SUMMARY OF THE INVENTION

The main object of this invention is to provide a method for forming a dresser pad for chemical mechanical polishing.

It's another object of this invention to provide a method for forming diamond abrasive wheel on CMP pad dresser.

It's still another object of this invention to prvide a chemical mechanical polishing pad dresser.

The process of this invention includes production of the bottom seat, then checking the bottom seat. If the bottom seat matches specification, then proceeding to the pre-process of the bottom seat. Then preparing a welding metal powder and organic glue, mixing the welding metal powder, organic glue and an adequate ratio of water to form a thick welding liquid, and using screen printing, spraying or other film production technology to uniformly distribute or paste on the aforesaid dresser bottom seat to form a sintering layer. Then, the computer visual inspection system is used to uniformly distribute the sieved diamond grains on the sintering surface, and after diamond peak planarization process, the aforesaid dresser is placed in the high temperature stove, and sintered in a vacuum environment, a protection atmosphere or a hydrogen stove to make the CMP pad dresser.

After sintering in the high temperature stove, the flatness of the dresser has to be checked. Then the real test is conducted to make sure of the polishing function of the formed dresser.

BRIEF DESCRIPTION OF THE DRAWINGS

FIGS. 2A, B, C are the illustration of the bottom seat in this invention, wherein FIG. 2A is circular disk type.

DETAILED DESCRIPTION OF THE PREFERRED EMBODIMENT

Figure 1:
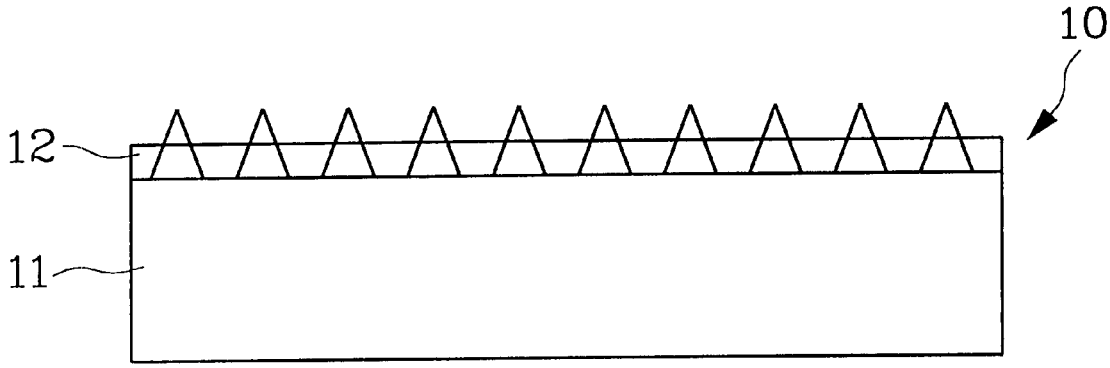
FIG. 1 is the side illustration of the formed dresser in this invention.

This invention is about the method for forming dresser of polishing pad of CMP machine. Please firstly refer to FIG. 1, which is a side drawing of dresser. The aforesaid dresser 10 has a bottom seat 11, wherein a polishing layer 12 is formed. The aforesaid bottom seat 11 usually is a stainless steel plate; the aforesaid polishing layer 12 is a polishing pad with diamond grains. This invention is to reveal a method of forming a polishing layer 12 on the aforesaid bottom seat 11.

The steps revealed in this invention are as follows: the first is the production of the bottom seat, then checking the bottom seat. If the bottom seat matches specification, then proceeding the pre-process of the bottom seat. Then preparing welding metal powder and organic glue, mixing the welding metal powder, organic glue and adequate ratio of water to form welding thick liquid, and using screen printing, spraying or other film production technology to uniformly distribute or paste on the aforesaid dresser bottom seat to form sintering layer. Then using the computer visual inspection system to uniformly distribute the sieved diamond grains on the sintering surface, and after diamond peak planarization process, putting the aforesaid dresser in the high temperature stove, proceeding sintering in vacuum environment, protection atmosphere or hydrogen stove to make the polishing layer on CMP pad. Besides, in this invention, sieved diamond grains can first be uniformly distributed on the aforesaid dresser bottom seat, then mix the welding metal powder, organic glue and adequate ratio of water to form welding thick liquid, and use screen printing, spraying or other film production technology to uniformly distribute or paste on the aforesaid dresser bottom seat to form sintering layer. After sintering process in high temperature stove, the flatness of the dresser has to be checked. Then to proceed the real test to make sure the polishing function of the formed dresser. Then proceeding static visual inspection and cleaning. At last the dresser is packed for delivery. The aforesaid method of CMP pad dresser formation is completed here.

Figure 2A:
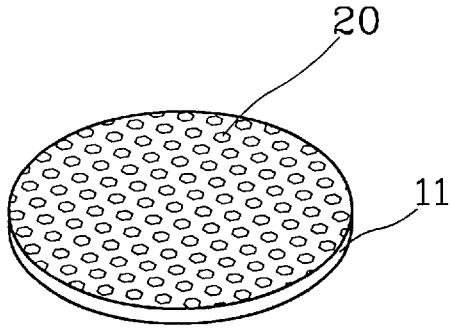
Figure 2B:
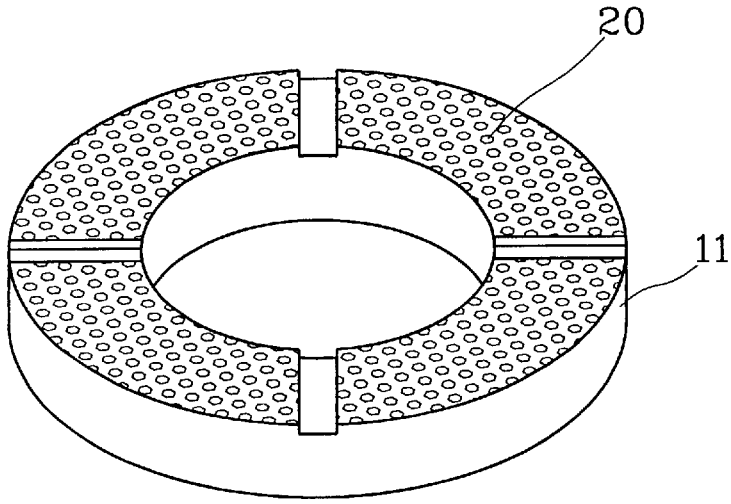
FIG. 2B is donut type.
Figure 2C:
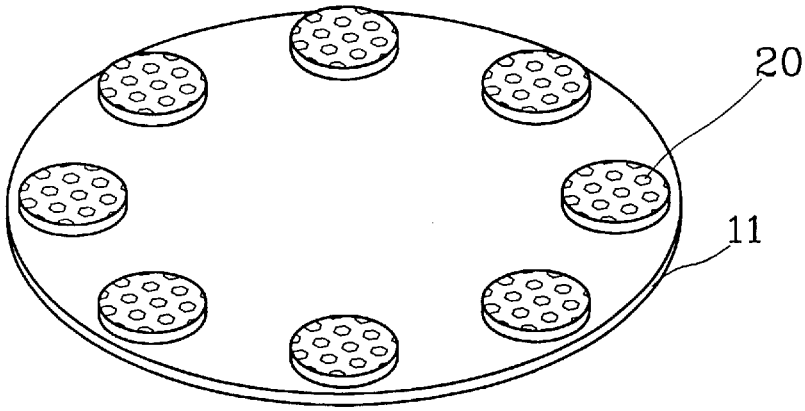
FIG. 2C is assembly type.

Please refer to FIG. 2, the normal bottom seat 11 has three kinds, FIG. 2A is circular disk type, FIG. 2B is donut type, FIG. 2C is assembly type, wherein rounded grains represent diamond grains 20. The aforesaid bottom seat inspection items are to check its parallel, flatness and any defects resulting from scratch on the bottom seat surface. The aforesaid bottom seat pre-process is to proceed defatted process first, then roughing the aforesaid bottom seat surface for continuing sintering process.

The choice of the aforesaid welding metal powder has a lot of considerations. Cause the slurry used in CMP is strong acid or strong alkalinity; the metal material used on the polishing pad dresser must have resistance to strong acid and alkalinity. Besides, heavy metal pollution should be avoided as possible in all semiconductor processes, so the metal material choice should avoid these pollution materials. The metal powder in this invention is from Ti, Sn, Fe, Co, Ni, Cr, B, Si, W, Mo and etc. The aforesaid organic glue includes two kinds chosen from polyethylene glycol (PEG), polyethylene oxide, polyvinyl acetate (PVA), methyl cellulose, dextrin, amyl dextrin and other high polymer organisms.

The main object of adding Ti, Cr, W and other active elements is to activate chemical reaction under the high temperature from liquid sintering welding and to make the aforesaid elements and the carbon of diamond forming chemical bonding. The ratio of the aforesaid active metal has to be precisely controlled, if the ratio is not enough, the wet combination is worse; if the ratio is too much, the welding metal will form too much metal phase and make the welding metal hard and brittle and the diamond tool will have heat stress destruction. Besides, if the W is added too much, the joint crystal melting temperature of the whole stainless steel base welding material will be increased and largely increase wet angel. So the aforesaid active metal weight ratio has to be controlled between 1% and 30%.

Figure 3:
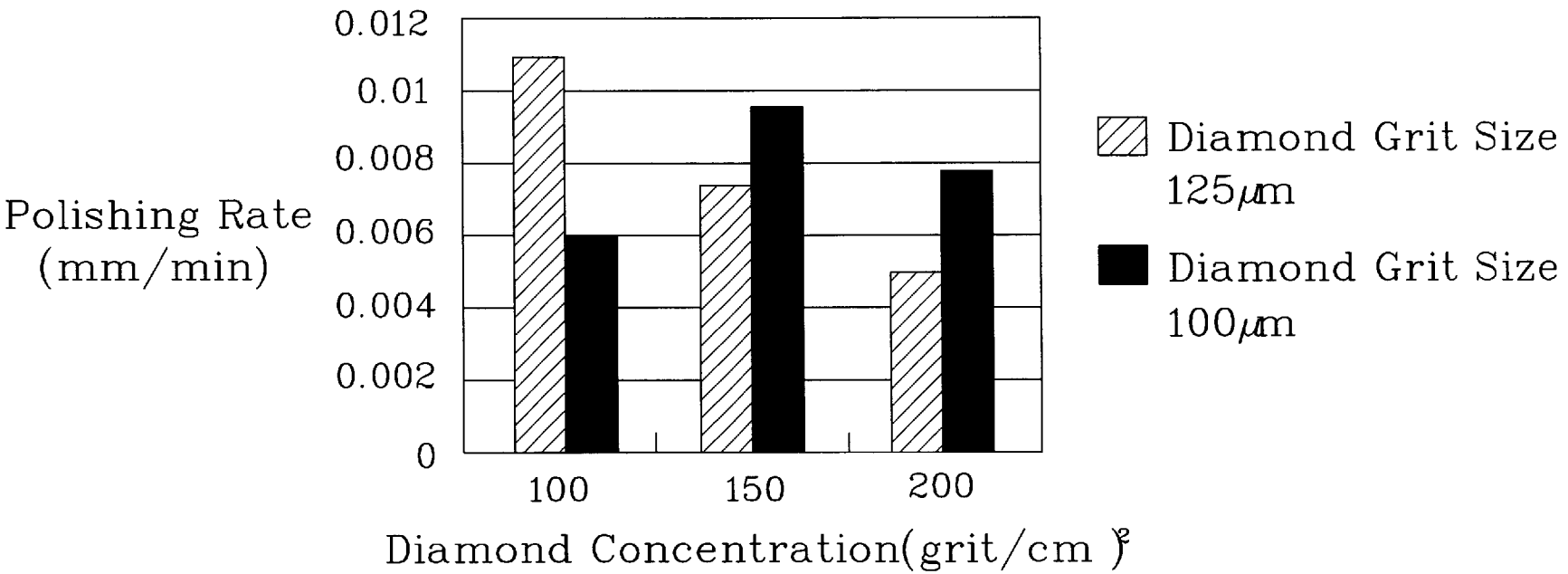
FIGS. 3 is the experiment result of optimal design parameter decision in this invention.
Figure 4A:
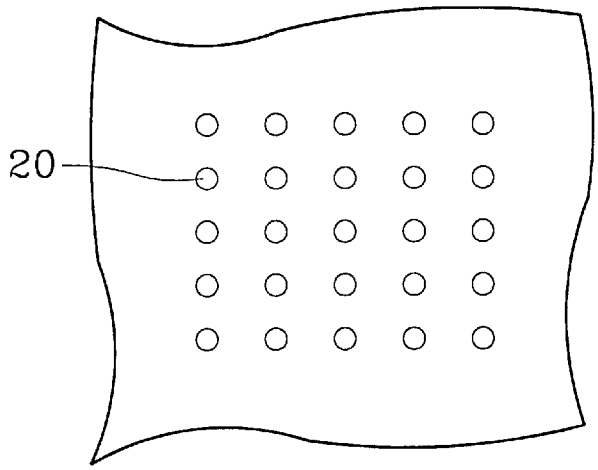
FIGS. 4A, B, C is the illustration of diamond distribution in this invention, wherein FIG. 4A
Figure 4B:
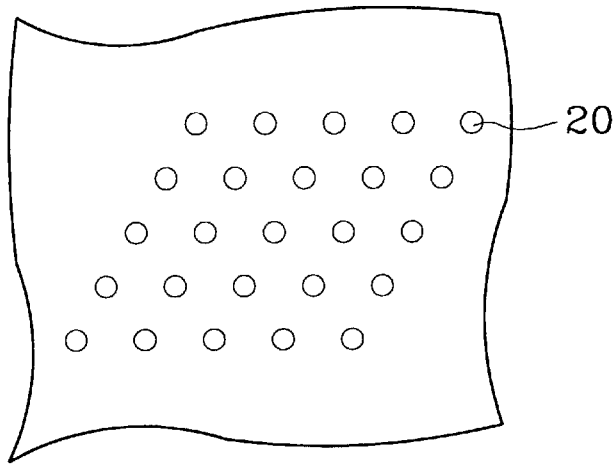
FIG. 4B is matrix distribution and FIG. 4C is the honeycomb distribution.
Figure 4C:
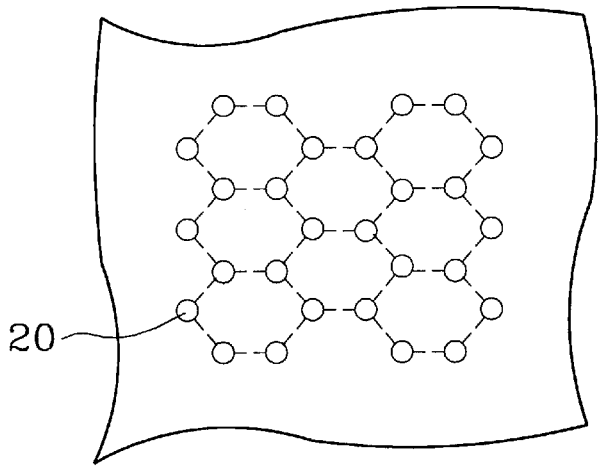

Then distributing the sieved diamond grains uniformly on the welding metal surface is the key point of this invention. All of the diamond grain size, distribution density and diamond grain exposure ratio have large effects on the quality of the polishing pad dresser. To form the dresser with best polishing quality, this invention adopts the diamond grains with many protruding cutting faces; the diamond grains must be clean and without crack, the grain size must be between 50 to 250 micrometers, with 60 to 2500 grains distribution per square centimeter and make the diamond exposure ratio between 50% to 90%. Please refer to FIG. 3, which shows the experiment result of optimal design parameter decision in this invention. It's the compare chart of polishing ratio under different assembly of diamond grain sizes and distribution density. From FIG. 3, it seems that the best polishing ratio is under the design of 100 diamond grains with 125 micrometers in diameter distributed per square centimeter. Besides, different from the conventional random diamond grain distribution, this invention uses computer visual inspection system to position the diamond grains uniformly on the base and the tolerance of diamond density should be controlled in 10%. The aforesaid regular distribution is a kind of single grain, multi-grains or crowded distribution; it can be as matrix distribution of FIG. 4A and FIG. 4B or honeycomb distribution of FIG. 4C. The aforesaid circle points on FIGS. 4A, B and C represent diamond grains 20.

Finally, in the sintering welding process, placing the aforesaid dresser in the high temperature stove and proceeding sintering in vacuum environment, protection atmosphere or hydrogen stove. After putting the dresser into the high temperature stove, the temperature rising speed is between 3° C. and 20° C. per minute, the sintering welding temperature control is between 700° C. and 1100° C. and lasting for 10 to 60 minutes. This invention uses active metal to form stable metal carbonate layer on the diamond surface to bond, the generation free energy at 900° C. is about 180 KJ to 120 KJ per mole. This high strength chemical bonding compared to the conventional electroplating physical bonding has higher fastening strength of diamond grains on the dresser and the diamond grains will not drop out during the polishing pad pruning process, the diamond grain usage ratio almost can reach 100%.

This process adopts the liquid sintering welding method; the used welding metal has good wet lubrication. So if the thickness is not uniform during welding thick liquid coating process or the diamond grain arrangement is not uniform during the diamond spray process, the diamond grains will rearrange uniformly due to welding surface tension during the sintering welding process. So the diamond grain exposure ratio can be precisely controlled and the diamond distribution is absolutely uniform; the formed polishing pad dresser will have the best polishing quality and the difference of polishing uniformity is little. Furthermore, the polishing layer formed in this invention is easy to get rid of trifle and has smooth flow of slurry due to wide space between diamond grains.

The aforesaid planarization check is mainly to check whether the exposure height of each diamond grain on the surface of the formed polishing layer is uniform or not. If the exposure height is not uniform, and proceeding the pruning of the polishing pad, the force given from the dresser on the polishing pad will not be uniform and seriously affect the pruning quality. Besides, the aforesaid planarization check includes the bottom seat itself; that is to check the part without polishing layer sintering will deform or not during the sintering process in high temperature stove.

The aforesaid static visual inspection is to check if the distance between diamond grains, arranging density and uniformity is correct and to check if the diamond grain size and exposure ratio match the specification.

It may thus be seen that the objects of the present invention set forth herein, as well as those made apparent from the foregoing description, are efficiently attained. While the preferred embodiments of the invention have been set forth for purpose of disclosure, modifications of the disclosed embodiment of the invention as well as other embodiment thereof may occur to those skilled in the art. Accordingly, the appended claims are intended to cover all embodiments that do not depart from the spirit and scope of the invention.

What is claimed is:

1. A method of forming a dresser pad for chemical mechanical polishing comprising the steps of:

a) providing a flat metal bottom seat with an upper surface, the bottom seat having a circular periphery;

b) mixing welding metal powder, organic glue and water to form a liquid;

c) uniformly distributing the liquid on the flat metal bottom seat so as to form a single sintering layer on at least a portion of the upper surface;

d) uniformly distributing diamond grains in the sintering layer, the diamond grains having a grain size between 50 and 250$\mu$m and a distribution of between 60 and 2500 grains per square centimeter; and, e) sintering the sintering layer by heating the flat metal bottom seat, the sintering layer and the diamond grains at a rate of between 3° C. and 20° C. per minute to a temperature of between 700° C. and 1100° C. for between 10 and 60 minutes.

2. The method of forming a dresser pad of claim 1 wherein the diamond grains are distributed so as to have a diamond exposure ratio of between 50% and 90%.

3. The method of forming a dresser pad of claim 1 wherein the welding metal powder is selected from the group consisting of Ti, Sn, Fe, Co, Ni, Cr, B, Si, W and Mo.

4. The method of forming a dresser pad of claim 1 wherein the organic glue is selected from the group consisting of polyethylene glycol, polyethylene oxide, polyvinyl acetate, methyl cellulose, dextrin and amyl dextrin.

5. The method of forming a dresser pad of claim 1 wherein the liquid is uniformly distributed over the entire upper surface of the bottom seat.

6. The method of forming a dresser pad of claim 1 wherein the flat metal bottom seat has an annular configuration.

7. The method of forming a dresser pad of claim 6 wherein the liquid is uniformly distributed over the entire upper surface of the bottom seat.

8. The method of forming a dresser pad of claim 1 wherein the liquid is uniformly distributed in a plurality of spaced apart portions of the upper surface of the bottom seat.

9. The method of forming a dresser pad of claim 1 wherein the liquid is uniformly distributed by screen printing.

10. The method of forming a dresser pad of claim 1 wherein the liquid is uniformly distributed by spraying.

* * * * *